United States Patent [19]

Tiernan et al.

[11] 3,934,625

[45] Jan. 27, 1976

[54] FOOD DISPENSING VALVE MEANS AND CONTROL SYSTEM FOR AUTOMATIC CONTAINER FILLING MACHINES

[75] Inventors: Stanton W. Tiernan, Baltimore; Richard R. Epple, Glen Burnie, both of Md.

[73] Assignee: Maryland Cup Corporation, Owings Mills, Md.

[22] Filed: Sept. 30, 1974

[21] Appl. No.: 510,575

[52] U.S. Cl. ..... 141/115; 141/140; 141/248; 141/258

[51] Int. Cl.[2] ..... B65B 3/04

[58] Field of Search ..... 141/258–262, 141/140–143, 156–162, 115–127, 248, 128

[56] References Cited

UNITED STATES PATENTS

| | | | |
|---|---|---|---|
| 3,168,225 | 2/1965 | Miller et al. | 141/157 |
| 3,847,162 | 11/1974 | Seil | 141/261 |

*Primary Examiner*—Houston S. Bell, Jr.
*Attorney, Agent, or Firm*—Birch and Birch

[57] ABSTRACT

A valve and control system for filling sequentially presented containers with measured charges of semi-solid food product and the like from a feed hopper is provided in which the food product is charged into a product cylinder from the feed hopper through the valve and then discharged into a container through the valve in timed sequence with the reciprocating strokes of a piston in the product cylinder. Means are provided to monitor the discharge stroke of the piston to reverse the valve from the discharge position to the charge position before the discharge stroke of the piston is completed to cause the food product in the product cylinder to be returned to the feed hopper. This results in a dynamic discharge that precludes tailing of the food product at the valve discharge port and maintains the food product in the feed hopper in a homogenized state. The stroke of the piston is adjustable to predetermine the quantity of food product dispensed. An override is provided to preclude discharge of food product in the absence of a container to filled.

19 Claims, 11 Drawing Figures

10
4
CVI
A
B
STROC
TO CVI (2)
TO CVI (4)
24
26
12B2
12B
12B1
22 C
22
22D
22A
22B
PV4
TO CV2(B)
B
TO PV3(B)
14
16C
VS3
18
FS
34B
34A
34A1
34A2
34A3
PV5
LC
30
32B
6
DL6
DL7
28
DL
DL2
DL2A
DL1
DL10
34
34E
5

FOOD DISPENSING VALVE MEANS AND CONTROL SYSTEM FOR AUTOMATIC CONTAINER FILLING MACHINES

FIELD OF THE INVENTION

This invention relates to metering devices for dispensing semi-solid food products, and more particularly to a volumetric valve structure and control system for same for dispensing predetermined quantities of semi-solid material into a succession of containers.

BACKGROUND OF THE INVENTION

In the automated packaging of semi-solid food products such as cottage cheese it is highly desirable that products be accurately measured into containers and that product waste be reduced to a mimimum during the filling process.

In the prior art for example, valves for metering such food products into containers have suffered from what is known in the art as "tailing", i.e., the retention of such food product in the outlet nozzle or spout of a dispensing valve which tends to drop out of the spout under the force of gravity or under the drawing effect of preceeding food product as it exits the dispensing spout, with the end result that different volumes of food are presented to each successive container and spillage of the food product occurs between the presentations of containers resulting in product waste and potentially unsanitary conditions since the need for cleaning of the equipment area is increased and rendered more difficult.

Past efforts to prevent tailing and waste have involved the use of complex valve motions such as a suction stroke after the dispensing stroke to draw material back into the dispensing spout and multiple piston valves with the attendant requirements of complex volume adjustments, timing and control systems and difficulty in cleaning and sanitizing the valve structures.

Thus, there is a long felt need in the art for a simple and accurate volumetric filling valve and control system for same which is fully adapted for the automated filling of containers with semi-solid food products and which, at the same time, precludes tailing, minimizes waste and can be cleaned and sanitized with a minimum of effort. Furthermore, an additional desired feature in any such valve is the ability to make rapid and accurate volumetric adjustments of such a valve without the necessity of shutting down the filling machine with which it is associated during a production run.

OBJECTS OF THE INVENTION

It is an object of the present invention to provide a new and novel volumetric valve for dispensing semi-solid food products.

Another object of the present invention is to provide a new and novel volumetric valve and control system for same for the automated dispensing of semi-solid food products into a succession of containers with maximized accuracy and minimized waste.

Another object of the present invention is to provide a new and novel volumetric valve and control system for same for the automated dispensing of semi-solid food products into a succession of containers with maximized accuracy and minimized waste; and which valve is adjustable while operating to preclude the necessity of shutting down its associated equipment during a production run.

These and other objects of the present invention will become more fully apparent with reference to the following detailed description and drawings which relate to a preferred embodiment of the present invention.

SUMMARY OF THE INVENTION

A gravity hopper is provided for holding semi-solid food product and has a bottom dispensing port feeding into one side of a valve chamber containing an oscillatable cylindrical valve spool having an arcuate valve passage cut therein transverse to the axis of rotation of the cylinder.

In one position of the valve spool, the outlet port of the feed hopper is placed in communication with a pump chamber or product cylinder in which a product piston reciprocates to draw material from the feed hopper on a first stroke and force the material out through the valve spool on a second stroke.

In a second position of the valve spool, the product cylinder is placed in communication with an outlet port in the valve body so that the second stroke forces food product out through the outlet port (and into a container beneath that port.)

The stroke of the product piston is adjustable to meter the amount of food product drawn into the product cylinder from the feed hopper as well as the amount ultimately dispensed through the dispensing (valve outlet) port.

The valve spool is oscillated between its first and second positions in timed synchronism with the strokes of the product piston and further, as constrained by the presence or absence of a container beneath the dispensing port, such that the material is always dispensed under positive pressure from the product piston and not by gravity action. Specifically, the valve spool is abruptly actuated from its second (dispensing) position to its first (charging) position before the product piston has completed its second (dispensing) stroke. When this occurs, the product being dispensed has sufficient retained velocity to fully discharge into a waiting container and the excess product present in the product cylinder is forced back into the feed hopper.

This latter action has the additional useful purpose of agitating the semi-solid food product in the hopper for each reciprocation of the product piston, thus precluding settling and separation and enhancing the homogeneity of the food product.

The dispensing outlet on the valve body has a minimal axial length such that there is substantially no spout area in which food product can collect and either tail or spill out by gravity. Accordingly, substantially the entire volume of food product delivered to the dispensing outlet by the product piston ends up in the container to which it is directed.

In the absence of an unfilled container in registry with the dispensing outlet, this condition is sensed and an override control is actuated to maintain the valve spool in its first (charging) position. The product piston, in the meantime continues to reciprocate and move food product back and forth between the feed hopper and the product cylinder.

In adjusting for the volume of product to be dispensed, the stroke of the product piston is adjusted. Since the valve spool is constantly timed with respect to the discharge or dispensing stroke of the product piston, only one degree of adjustment is required for an accurate volumetric discharge of the food product.

In the preferred embodiment of the invention timing cams operate pneumatic control switches to time pneumatic actuating cylinders for both the product piston and valve spool and a pneumatic switch is utilized to sense the presence or absence of a container to be filled. Basically, the stroke adjustment of the product piston is by a coarse and fine adjustment of a fulcrum point in the drive linkage between the product piston and its pneumatic actuating (stroke) cylinder, the latter operating at full stroke. A pneumatic sensor switch is provided adjacent the piston actuating (stroke) cylinder to sense the advent of the end of the discharge stroke of the product piston to thereby trigger the actuating (spool) cylinder for the valve spool to shift the latter to its charging position prior to the termination of the said discharge stroke.

The product cylinder is provided with removable sleeve liners of various dimensions and the product pistons are interchangeable to provide rapid adaptation of the invention to various volumetric ranges.

GENERAL DESCRIPTION OF THE DRAWINGS

FIGS. 1*a* and *b* is a side view of the valve of the present invention mounted on a container filling machine with details of the product piston verniers adjustment and timing control means in partial cross-section;

DETAILED DESCRIPTION OF THE DRAWINGS

Figure 1A:
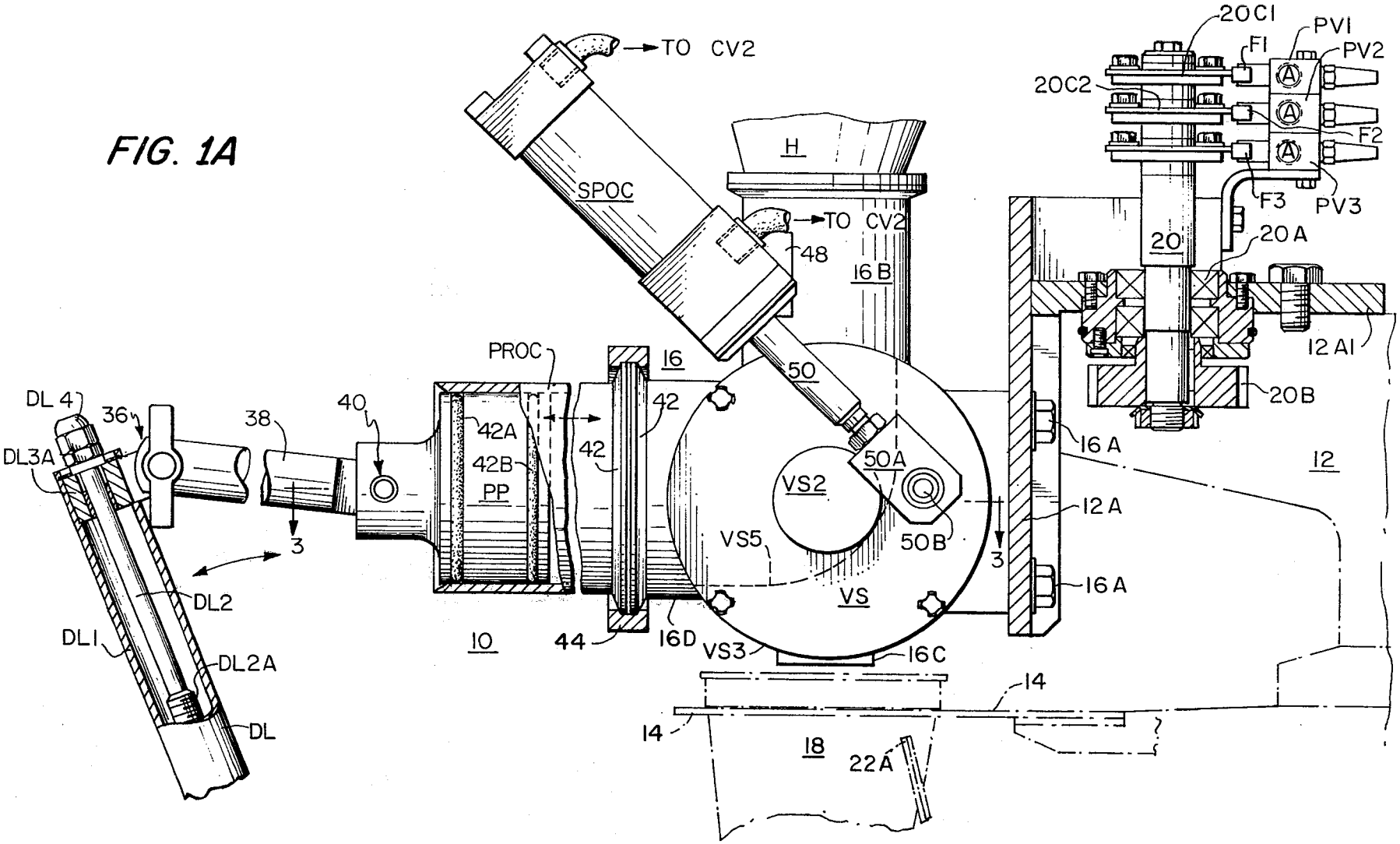
Figure 1B:
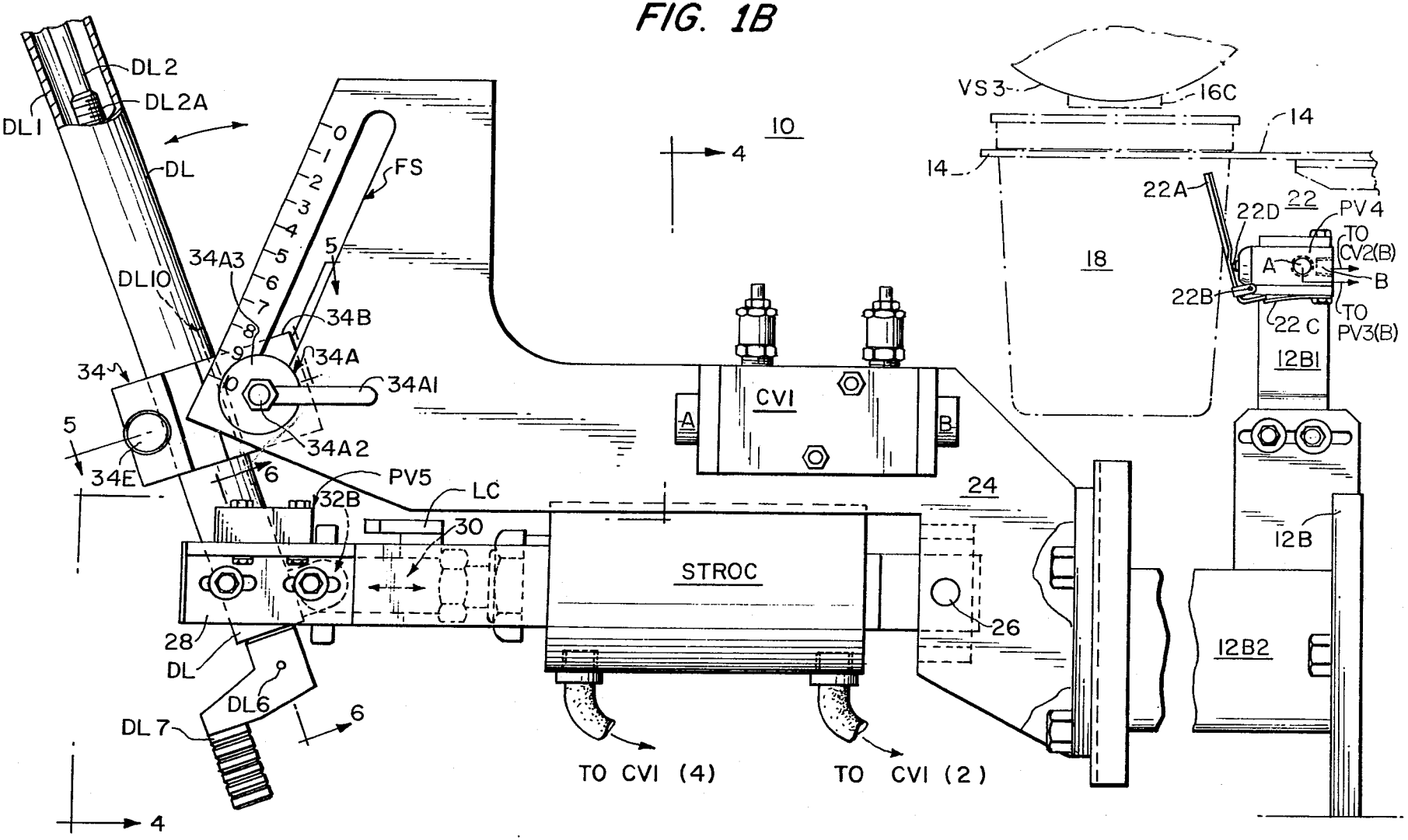

Referring in detail to the drawings and with initial reference to FIG. 1, the volumetric valve means 10 of the present invention is shown mounted outboard of the center post or standard 12 of a rotary container filling machine which is schematically shown as including a container advancing dial 14 which is driven in rotation about the center post 12 in a manner well known in the art. Similar machines are shown in U.S. Pat. No. 3,225,889 of John B. West issued Dec. 28, 1965, in which various subassemblies are mounted outboard of a center post and driven by a common drive means through suitable power takeoff gearing.

In the present invention, a first vertical bracket 12A is provided above the container dial 14 to removably mount the rotary valve 16 of the present invention immediately above the container retaining area of the dial 14 by means of bolts 16A or any other suitable connecting means.

A container 18 to be filled from the rotary valve 16 is shown positioned beneath the valve 16 in the dial 14.

The bracket 12A further includes a horizontal bearing plate 12A1 through which is mounted, in suitable journal bearings 20A, a timing cam shaft 20 having a power takeoff gear 20B at its lower end and a multiplicity of timing cam means 20C at its upper end; the said shaft 20 and the timing cam means 20C being driven in synchronism with the container dial 14 and the remainder of the filling machine by the power takeoff gear 20B in a manner well known in the art.

The timing cam assembly 20C includes a charge cam 20C1, a discharge cam 20C2 and a pulse cam 20C3 operating through suitable follower means F1, F2 and F3, respectively, to activate pilot valves PV1, PV2 and PV3 in timed synchronism with the drive of the filling machine.

A second vertical bracket 12B is provided beneath the container dial 14 having a vertical extension 12B1 on which is mounted a container sensor assembly 22 comprising an upstanding sensing finger 22A spring biased via a pivot 22B and leaf spring 22C into the path of the container 18 in the dial 14 such that the sensinger finger 22A is pivoted clockwise of the pivot 22B when a container 18 is in proper position beneath the rotary valve 16 to receive a dispensed charge of food product or the like.

This displacement of the sensing finger 22A actuates a valve button or trigger 22D on a pilot valve PV4 for the purpose of enabling a dispensing sequence in the valve 16 as will be more fully described hereinafter.

A horizontal extension 12B2 is provided in the bracket 12B on which is secured a bifurcated support bracket 24 for a pneumatic stroke cylinder STROC, the latter being mounted on a suitable pivot 26 inboard of the bracket 24.

Mounted above the stroke cylinder STROC on the bracket 24 is a first control valve CV1 having forward and reverse pressure connections with the cylinder STROC 9 to be fully described with reference to FIG. 7) for driving the latter in a conventional manner, namely, reciprocation between two extreme positions.

The opposite end of the stroke cylinder STROC from its pivot 26 includes an axially extended support plate substantially parallel to the piston rod 30 of the said stroke cylinder on which is mounted a discharge terminating pilot valve PV5 which, through a follower mechanism F5 is actuated by a limit cam LC mounted on the piston rod 30 of the stroke cylinder STROC to engage the follower F5 toward the outer extent of the stroke of the piston rod 30.

Figure 4:
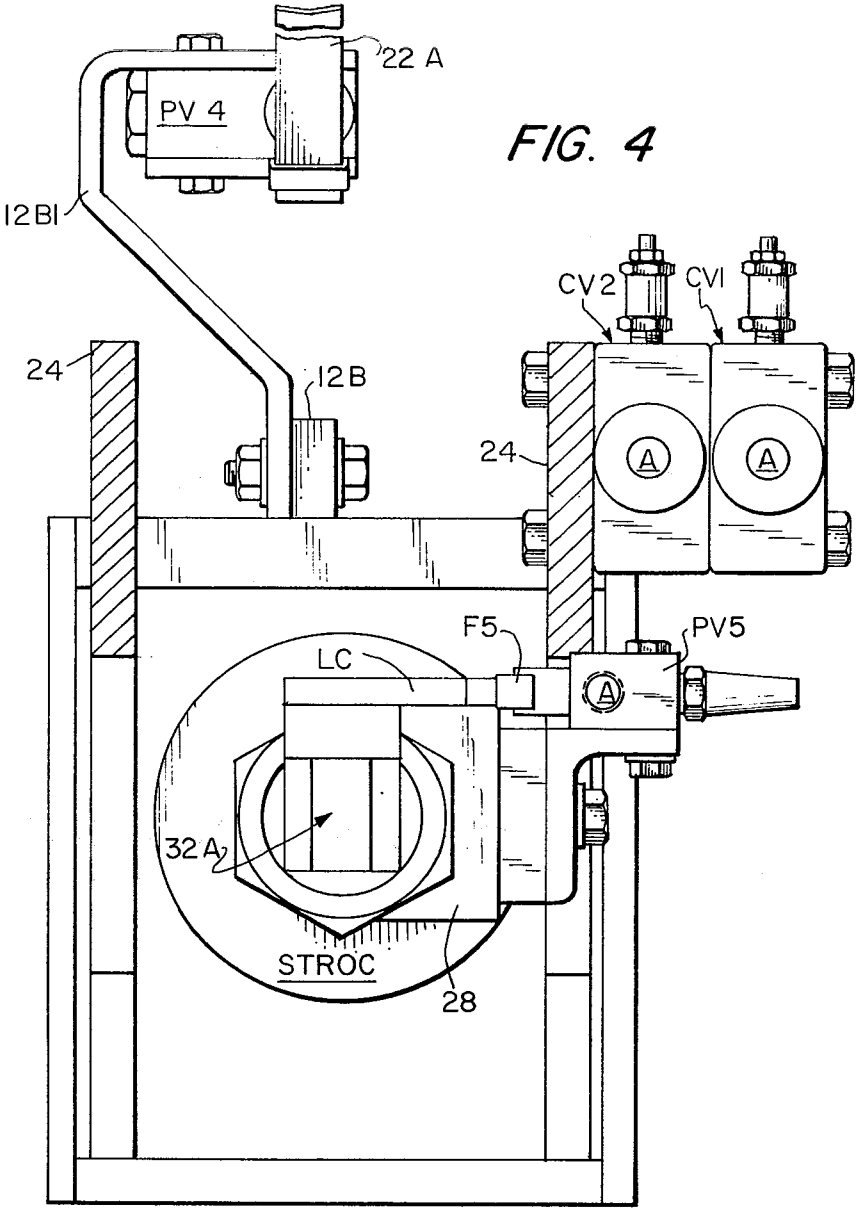
FIG. 4 is an end view of the actuating (stroke) cylinder and stroke sensing mechanism of the present invention.

Referring jointly to FIGS. 1 and 4, there is shown a bifurcated socket 32A in the outboard end of the piston rod 30 which is adapted to receive a drive coupling or ear 32B near the lower end of a main drive link DL. The drive link DL is not shown in FIG. 4 in order that the relative positions of the limit cam LC, follower F5 and discharge control pilot valve PV5 can be more clearly shown.

A second main control valve CV2 is shown in FIG. 4 mounted inboard of and in registry with the first main control valve CV1 on the bifurcated support bracket 24. The second main control valve CV2 controls the stroke of a pneumatic valve spool driving cylinder hereinafter referred to as spool cylinder SPOC, to be more fully described hereinafter.

The main drive link DL is pivoted intermediate its ends by means of our adjustable fulcrum assembly 34 and is pivotally connected at its upper end via a pivotal drive connection 36 to the outboard end of a piston rod 38 extending to a drive pin coupling 40 on the outboard end of a product piston PP mounted for reciprocation in a product cylinder PROC. The function of the product piston PP and product cylinder PROC is to draw material from a feed hopper H mounted above the rotary valve 16 and to discharge that material through the valve 16 into a container 18 or back into the hopper H, depending upon the position of the valve 16 as determined by the spool cylinder SPOC. The product piston PP is provided with a pair of O-rings or piston rings 42A and 42B to provide a traveling seal within the product cylinder PROC.

The drive connection 36 and the drive connection 32A–32B between the drive link DL and the piston rods 38 and 30, respectively, are substantially identical.

Figure 6:
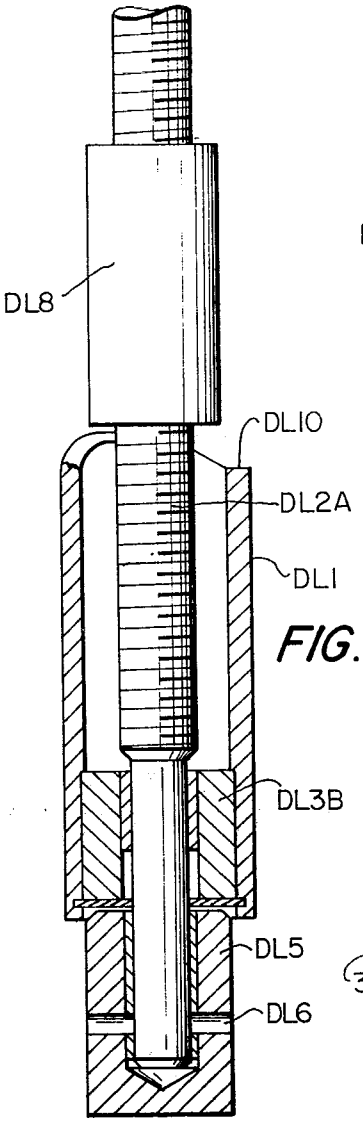
FIG. 6 is a partial cross-section of the vernier adjustment mechanism of the present invention taken along line 6—6 of FIG. 1.
Figure 5:
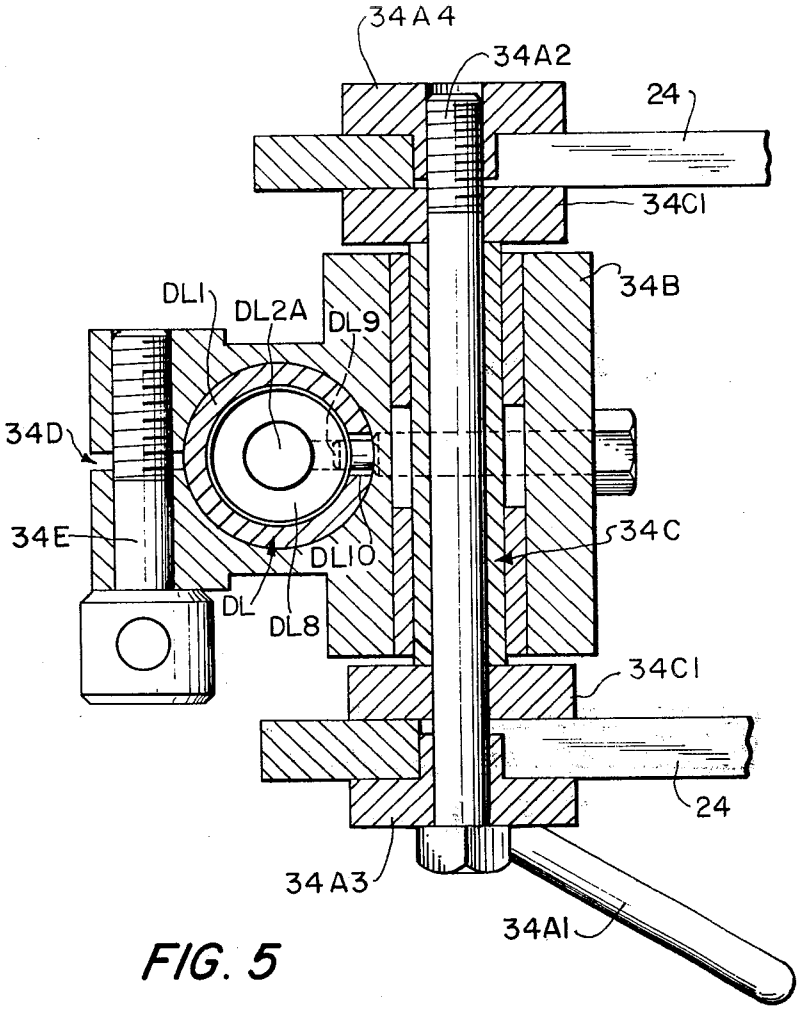
FIG. 5 is a cross-section of the adjustable fulcrum point of the present invention taken along line 5—5 of FIG. 1.

The stroke of the product piston PP is adjustable by means of the fulcrum assembly 34 which, referring jointly to FIGS. 1, 5 and 6, is shown as mounted in calibrated fulcrum slots FS formed in the bifurcated support bracket 24. The entire fulcrum assembly 34 is movable up and down in the slots FS by means of a clamp means 34A comprising a clamp lever 34A1, threaded shank 34A2 a cooperating washers 34A3, and a clamp nut 34A4 engaging the threaded shank 34A2.

The clamp shank 34A2 extends through a clamp block 34B which is journalled on sleeve bearings 34C to rock on the clamp shank 34A2, the latter thus comprising a fulcrum shaft for the fulcrum assembly 34. Thrust bearing washers 34C1 are provided on opposite ends of the block 34B to complete the bearing structure for the fulcrum assembly 34.

The clamp block 34B is bifurcated at 34D in the provision of a split cylindrical socket for the drive link DL which can be loosened to permit fine adjustment of the drive link DL therein by loosening a tightening screw 34E threaded across the bifurcated portion 34D.

The drive link DL includes an outer cylindrical shaft member DL1 and an internal shaft member DL2 coaxial with the outer shaft DL1 and having a threaded portion DL2A intermediate the ends thereof. The internal shaft DL2 is journalled in bearing sleeves DL3A and DL3B at the top and bottom thereof and secured in place in the outer link DL1 by a cap nut DL4 at the top end and a crank block DL5 and cross pin DL6 at the bottom end.

A crank handle DL7 for rotating the internal shaft DL2 is mounted on the crank block DL5 by means of the cross pin DL6.

The threaded portion DL2A of the internal shaft DL2 is threaded in an adjustment sleeve DL8, the latter being held fixed at the bifurcated socket, portion 34D of the fulcrum block 34B by a set screw DL9 extending through a longitudinal slot DL10 in the outer drive link DL1 to permit relative movement of the outer link DL1 to the inner shaft DL2 when the latter is turned in the adjustment sleeve by turning the crank handle DL7. Thus, the outer drive link DL1 of the drive link DL can be placed at a coarse adjustment fulcrum position by the clamp assembly 34A1 – A4 and at a finely adjusted fulcrum position relative to the coarse adjustment position by means of the inner shaft DL 2, crank DL 7 and the interaction of the threaded portion DL2A with the adjustment sleeve DL8 in the bifurcated socket portion 34D of the fulcrum assembly 34.

Figure 2:
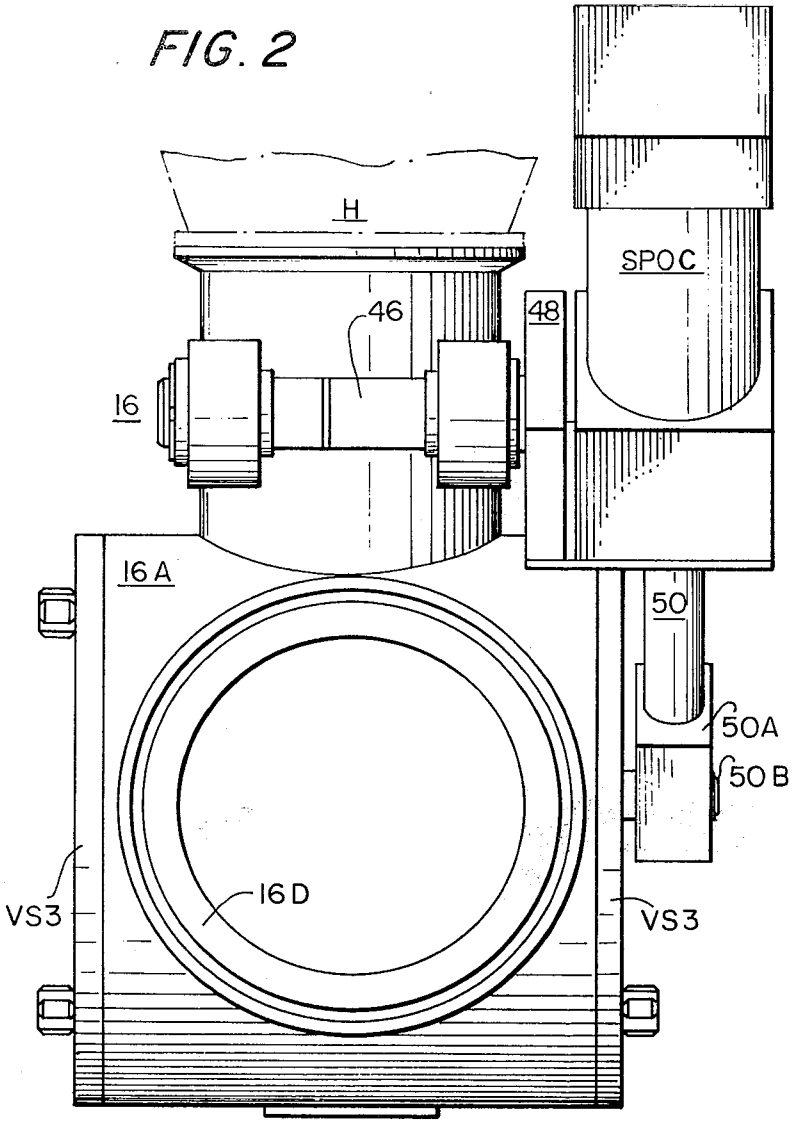
FIG. 2 is an end view of the valve of the present invention and its actuating (spool) cylinder looking into the coupling port between the said valve and the product cylinder.
Figure 3:
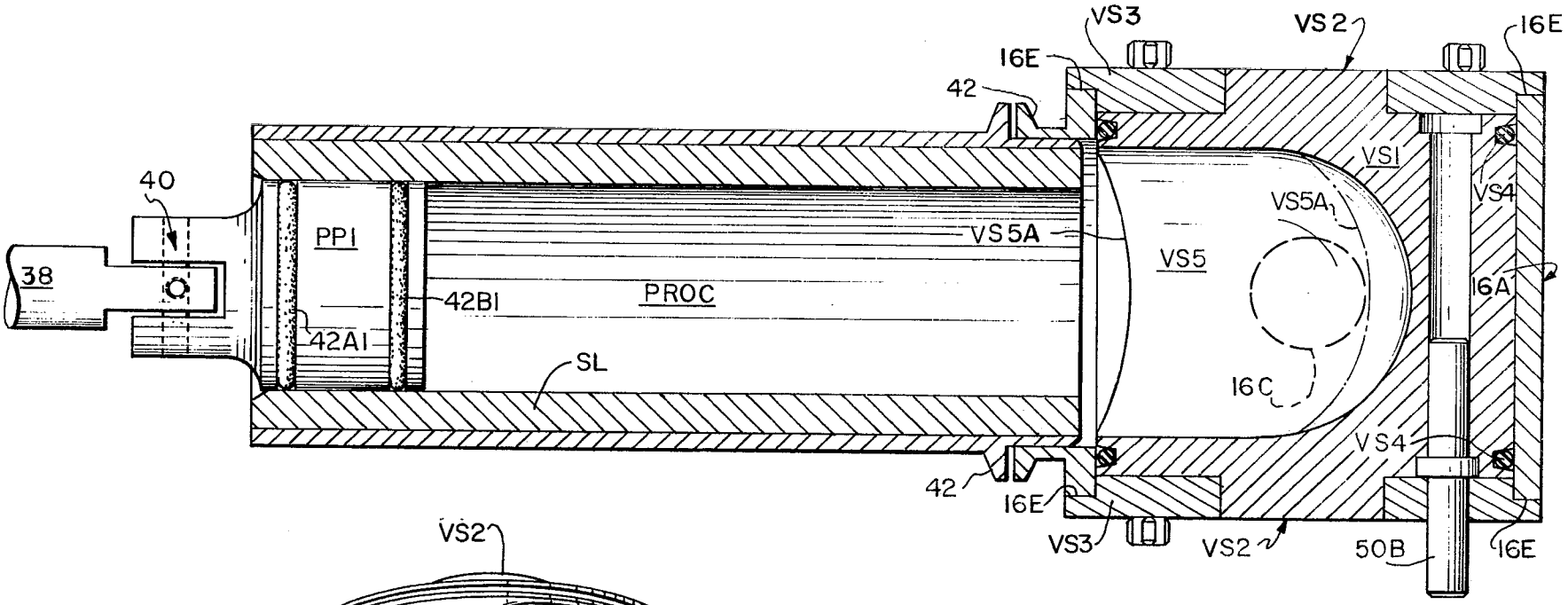
FIG. 3 is a cross-section of the valve and product cylinder of the present invention taken along line 3—3 of FIG. 1.

Referring now to FIGS. 1, 2 and 3, the charging and dispensing valve 16 of the present invention is shown as including a housing 16A having an upstanding charging conduit 16B on the top of the housing 16A connected with the feed hopper H and an axially aligned discharge port 16C of relatively reduced diameter beneath the charging conduit 16B in the bottom of the housing 16A.

A horizontally disposed product conduit 16D having its axis transverse that of the charging conduit 16B and discharge port 16C is provided in one side of the valve housing 16A such that the various conduits and ports are in a general T-coupling configuration.

The product cylinder PROC and the product conduit 16D have mating flanges 42 and a lock ring 44 holding them together such that one end of the product cylinder PROC is firmly mounted on the valve 16.

Figure 3A:
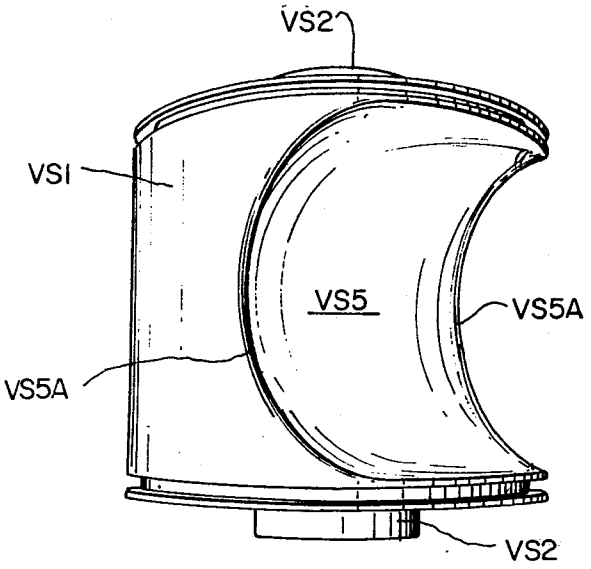
FIG. 3A is a perspective of the valve spool of the present invention.

The spool cylinder SPOC is mounted on a rocker shaft 46 and clamp assembly 48 which is welded or otherwise affixed to the exterior of the charging conduit 16B. A piston rod 50 extends from the spool cylinder SPOC into engagement with a clevis 50A pivotally connected to drive rod 50B extending through the valve spool assembly VS, the details of the latter being best shown in FIGS. 3 and 3A.

The valve spool assembly VS includes a cylindrical valve spool VS1 of molded nylon or the like having a pair of coaxial stub shafts VS2, one on either end thereof, over which are seated annular facing plates VS3 which overlay annular shoulders 16E at both sides of the valve housing 16A. A pair of O-rings VS4 are mounted one on each end of the valve spool VS1 to effect a seal with the interior surface of the valve housing 16A.

The valve spool VS1 is molded or milled out to provide an arcuate cavity VS5 therein that upon rotation of the spool VS1 to a first position (FIG. 8A and as shown in broken lines in FIG. 1) connects the feed hopper H and the charging conduit 16B with the product conduit 16D and the product cylinder PROC. When the spool VS1 is rotated to a second position (FIG. 8B) it connects the product cylinder PROC and product conduit 16D with the discharge port 16C.

The spool cavity VS5 is provided with arcuate edges VS5A which cooperate with the circular edges of the various conduits 16B, 16C and 16D to provide a scissors action (illustrated in broken lines in FIG. 3) to cleanly shear through the semi-solid food product that may be present at the interface of the said conduits with the edges VS5A of the spool cavity VS5 during rotation of the valve spool VS5 between its first and second positions.

It is desirable to have different capacities for the charging cylinder PROC depending upon the adjustable range of product volume in a given situation. Accordingly, as illustrated in FIG. 3, a smaller product piston PP1 and a sleeve liner SL are utilized within the product cylinder PROC to reduce the internal capacity of the latter and provide a finer degree of adjustment over the resulting range of product volumes dispensable at that capacity. The product piston PP1 is provided with O-ring seals 42A1 and 42B1 to provide a sliding seal with the inner surface of the sleeve liner SL.

Figure 7:
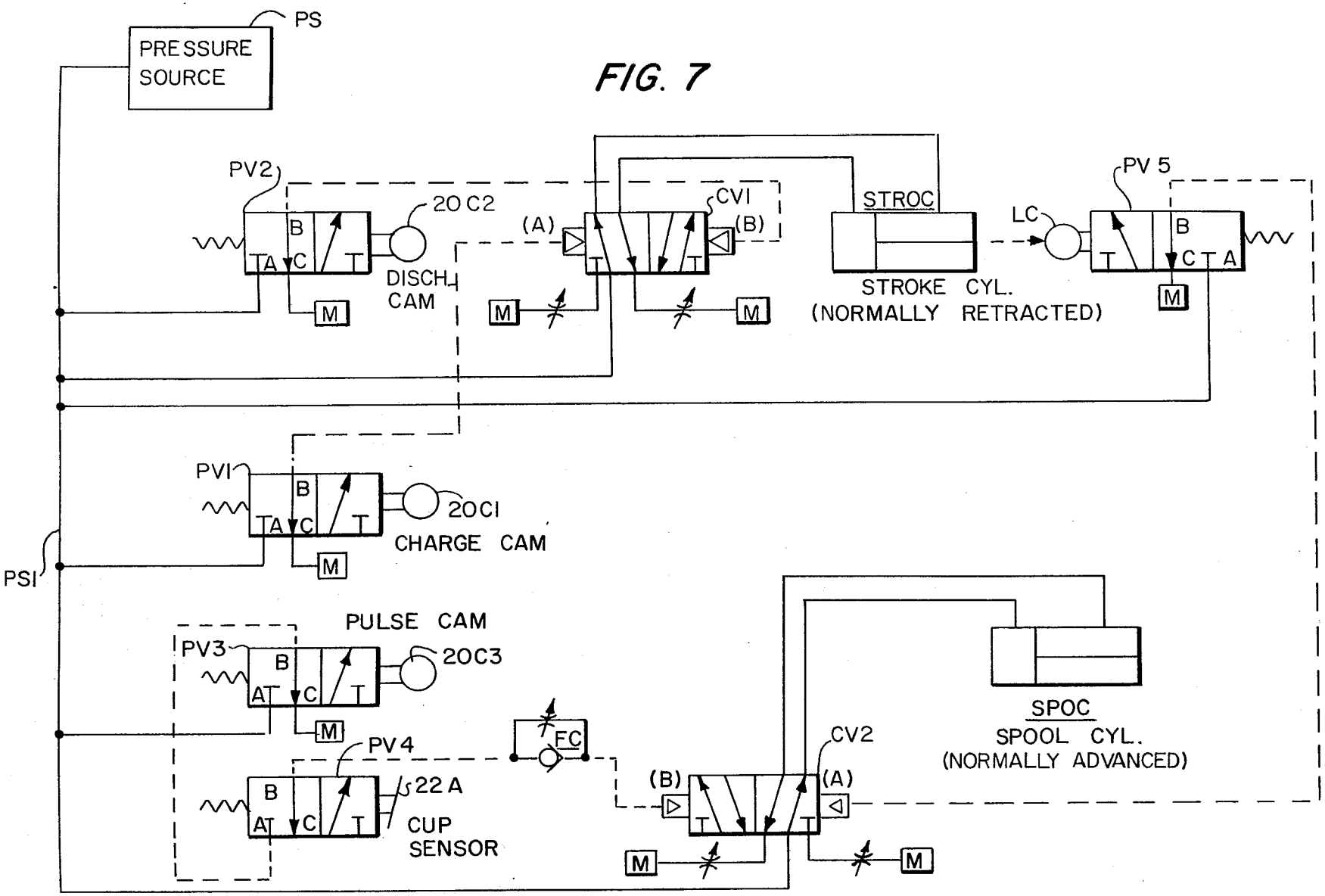
FIG. 7 is a schematic diagram of the pneumatic timing and control circuit of the present invention.

Referring now to FIG. 7, the pneumatic control circuit of the present invention is illustrated with the various pilot valves PV1 – PV5, control valves CV1 and CV2 and spool and stroke cylinders SPOC and STROC interconnected with a suitable pressure source PS as follows:

the pressure source PS has a common pressure lead PS1 connected to the input terminals A of the pilot valves PV1, PV2, PV3 and PV5 (NORGREN No. 202B pilot valves) by appropriate branch lines;

each of the pilot valves PV1 – PV5 has an input terminal A, an output terminal B and an exhaust terminal C and is actuatable by a mechanical input such as the timer cams 20C1 – C3, cup sensor 22A and limit cam LC, respectively;

the main control valves CV1 and CV2 (HANNA No. 37-03-001-03 control valves) have pressure input terminals (3) connected with the main pressure line PS1, control input terminals (A) and (B), exhaust terminals (1) and (5) and output terminals (2) and (4); the various exhaust terminals in each of the valves PV1 – PV3, PV5 and CV1 and CV2 are provided with suitable mufflers M;

the output terminal B of the first pilot valve PV1 (actuated by the charge cam 20C1) is connected to one control input (A) of the first control valve CV1 which the output terminal B of the second pilot valve PV2 is connected to the other control input (B) of the first control valve CV1, the output terminals (2) and (4) of the latter being connected to opposite sides of the stroke cylinder STROC;

the stroke cylinder STROC is operated in a normally retracted mode and when advanced actuated the fifth pilot valve PV5 through the limit cam LC, the latter being carried by the piston rod 30 (FIG. 1) of said stroke cylinder STROC;

the output B of the fifth pilot valve PV5 is connected to one control terminal (A) of the second control valve CV2, the latter having its output terminals (2) and (4) connected to opposite sides of the spool cylinder SPOC which is operated in the normally advanced mode;

the other control terminal (B) of the second control valve CV2 is connected through a suitable flow controller FC with the output terminal B of the fourth pilot valve PV4, the latter being actuated by the container sensor 22A and having its input connected to the output B of the third pilot valve PV3, the latter being actuated by the pulse cam 20C3;

clearly then, the flow path from the common pressure lines PS1 to the said other control terminal (B) of the second control valve CV2 is dependent upon the actuation of the pulse cam 20C3 and the simultaneous presence of a container 18 (FIG. 1) engaging the container sensor 22A.

OPERATION

The operation of the present invention will now be described with joint reference to FIGS. 1, 4, 7, 8A and 8B.

Assuming that the filling machine is shut down, the adjustable fulcrum assembly 34, via the fulcrum clamp 34A1, 34A2 is adjustably positioned in the fulcrum slot FS in the bifurcated bracket 24 such that the stroke of the product piston PP in the product cylinder PROC effected by the stroke cylinder STROC will be roughly adjusted to charge and discharge a predetermined volume of food product through the rotary valve 16.

Once operation of the filling machine has been started, a fine adjustment of the product volume dispensed is accomplished, during operation of the machine, by loosening the clamp screw 34E in the fulcrum assembly 34 and turning the crank handle DL7 to cause the drive link DL to vary its position in the bifurcated portion 34D of the fulcrum assembly 34 by the interaction of the threaded portion DL2A of the internal shaft DL2 with the threaded sleeve DL8. When the proper dispensed volume of food product is achieved, the clamp screw 34E is tightened to fix the adjusted fulcrum point with respect to the drive link DL and the production run of the machine is continued.

The hopper H is filled with a food product such as cottage cheese and the operation of the machine causes the power takeoff gear 20B to rotate the timing cams 20C1, 20C2, 20C3 via the cam shaft 20.

Figure 8A:
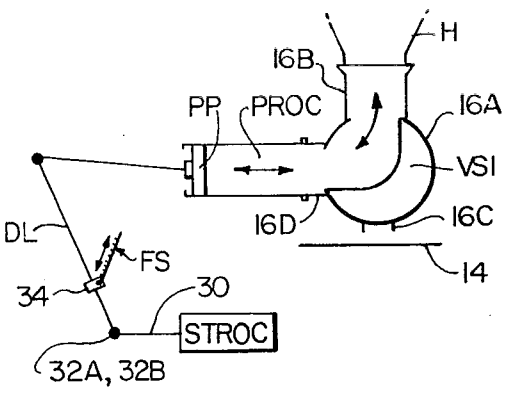
FIGS. 8A and 8B illustrate the two positions (charge and discharge) of the valve spool of the present invention.

The charge cam 20C1 (assuming that this cam commences a cycle of operation) actuates the pilot valve PV2 which in turn drives the first control input (A) of the main control valve CV1 which connects actuating pressure to the stroke cylinder STROC to retract the piston rod 30 therein and cause the product piston PP to assume the position shown in FIGS. 1, 3 and 8A, drawing a charge of product from the hopper H, through the valve spool cavity VS5 of the rotary valve 16 into the product cylinder PROC.

The discharge cam 20C2 then actuates the pilot valve PV2 through the cam follower F2 and the pilot valve PV2 actuates the second control input (B) of the first control valve CV1 to reverse the stroke of the stroke cylinder STROC and extend the piston rod 30, thus, forcing the product piston PP inward of the product cylinder PROC generating a discharge stroke of the product piston PP.

The pulse cam 20C3 actuates the third pilot valve PV3 through the cam follower F3 substantially at the same time the product piston PP begins its discharge stroke, thereby applying a pressure signal from the output B of the third pilot valve PV3 to the input A of the fourth pilot valve PV4 (FIG. 7), the latter being responsive to the output of the third pilot valve PV 3 only if there is a container 18 in the dial 14 beneath the discharge port 16C of the rotary valve 16 bearing against the sensing lever 22A.

Figure 8B:
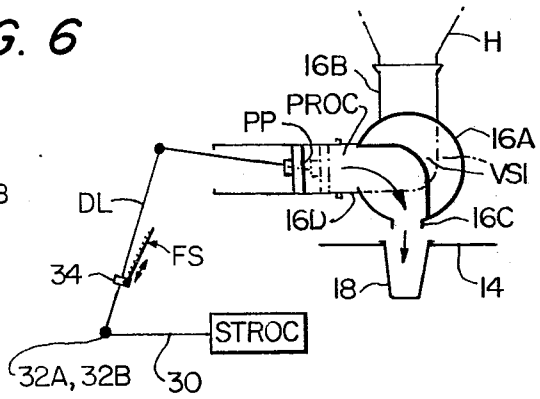

First, if a container 18 is present, the fourth pilot valve PV4 will provide the final connection from the pressure source PS to the control input (B) of the second control valve CV2 through the series path PV3, PV4, FC and cause the spool cylinder SPOC to rapidly retract the piston rod 50, thereby rotating the valve spool VS via the clevis 50A and drive pin 50B to the discharge (second) position shown in FIG. 8B. This connects the product cylinder PROC with the discharge port 16C of the rotary valve 16 through the valve spool cavity VS5 and the discharge stroke of the product piston PP forces the food product from the product cylinder, through the said spool cavity VS5, out of the discharge port 16C and into the container 18.

As the stroke of the power piston PP progresses toward the product port 16D of the rotary valve 16, the piston rod 30 of the stroke cylinder STROC progresses outward of the latter causing the limit cam LC to approach the follower F5 (FIG. 4) or the fifth pilot valve PV5. This limit cam LC engages the follower F5 and actuates the fifth pilot valve PV5 prior to the completion of the discharge stroke of the product piston PP.

The fifth pilot valve PV5, from its output B actuates the control input (A) of the second control valve CV2 and causes a substantially immediate reversal of the spool cylinder SPOC as a result. This rapidly extends the piston rod 50 and drives the valve spool VS back to its charge (first) position, thereby diverting the remaining food product in the product cylinder PROC back into the hopper H through the valve spool cavity VS5 during the remainder of the discharge stroke of the product piston PP.

Two highly desirable results are thereby effected. One is that the flow of food product being dispensed through the discharge port 16C is terminated while substantial velocity remains in the discharge of that product. Thus, the product carries into the container 18 under its own inertia and none remains in the discharge port as a tail or in a condition to slowly drip from the discharge port 16C under the action of gravity. Therefore, the full charge being dispensed ends up in the container 18. The second result is that the excess food product returned to the hopper H is forcibly returned against the action of gravity causing substantial agitation of the food product in the hopper H and maintaining that product in a homogenized state which is augmented for each and every discharge stroke of the product piston PP.

Furthermore, the arcuate edge VS5A of the valve spool cavity VS5 cooperates with the arcuate inner edge of the discharge port 16 to cleanly shear through the food product on the return stroke of the spool cylinder SPOC to further preclude the accumulation of material in the discharge port 16C.

Second, assuming that a cup 18 is not present in the dial 14, the fourth pilot valve PV4 will not operate and the flow path from the pressure source PS and the control input (B) of the second control valve CV2 cannot be completed.

This will cause the spool cylinder SPOC to remain in its normally extended condition, holding the valve spool VS5 in and the spool cavity VS5 in the charge (first) position of FIGS. 1 and 8A. The timing cams 20C1 – 20C3 continue to rotate, however, and the first and second pilot valves PV1 and PV2 continue to cycle as a result. Accordingly the stroke cylinder STROC continues to cycle and drive the product piston PP through its charge and discharge strokes in the product cylinder PROC via the drive link DL.

This action results in continued withdrawal and return of food product from and to the feed hopper H, maintaining the homogenized state of the food product in the event of a lapse in supply of containers 18 in the dial 14 as well as precluding operation of the rotary valve 16 until such time as a container 18 is available to receive a dispensed charge of food product.

As can be readily seen from the foregoing specification and drawings, the present invention provides a new and novel dispursing valve and apparatus for semi-solid food products having a positive dispensing action and retention of a homogenized condition of the food product and which further precludes tailing and spillage and improper dispensing of the product in the event of a lapse or failure of container supply in an automatic filling machine.

It is to be understood that the apparatus of the present invention may be modified as would occur to one of ordinary skill in the art without departing from the perspective and scope of the present invention.

We claim:

1. Means for dispensing measured charges of food product and the like from a feed hopper to each of a plurality of containers presented in sequence at a filling position, comprising:

a product cylinder having a piston reciprocable therein to provide charge and discharge strokes;

valve means having a charging port communicating with said feed hopper, a product port communicating with said product cylinder, a discharge port proximate to said container filling position and a valve element selectively interconnecting said product cylinder with said feed hopper and said discharge port;

first drive means reciprocating said piston to draw and return food product from and to said feed hopper and to discharge food product through said discharge port from said product cylinder as a function of the position of said valve element; and second drive means for said valve element positioning said valve element in a first position to interconnect said product cylinder with said feed hopper and in a second position to interconnect said product cylinder with said discharge port in synchronism with said piston; and timing means responsive to a predetermined position of said piston means during said discharge stroke to constrain said second drive means to switch said valve element from said second to said first position such that the remainder of said discharge stroke will return food product from said product cylinder back to said feed hopper and abruptly cut off the flow of food product through said discharge port to agitate the food product in said hopper and preclude tailing at said discharge port.

2. The invention defined in claim 1, wherein said dispensing means further includes control means actuating said first and second drive means to synchronize said charge and discharge strokes of said piston with said first and second positions of said valve member.

3. The invention defined in claim 1, wherein said dispensing means further includes:

sensing means sensing the presence and absence of a container at said filling position and disabling said second drive means in response to the absence of a said container to maintain said valve member in said first position during both said charge and discharge strokes of said piston.

4. The invention defined in claim 1 wherein said dispensing means further includes:

control means actuating said first and second drive means to synchronize said charge and discharge strokes of said piston with said first and second positions of said valve member; and sensing means sensing the presence and absence of a container at said filling position and disabling said second drive means in response to the absence of a said container to maintain said valve member in said first position during both said charge and discharge strokes of said piston.

5. The invention defined in claim 1, wherein said piston includes a first piston rod; and wherein said first drive means comprises a pneumatic stroke cylinder having an extendable second piston rod, a drive link connected at opposite ends to said first and second piston rods, and an adjustable fulcrum means intermediate the ends of said drive link;

said adjustable fulcrum means selectively controlling the stroke of said piston means and including coarse adjustment means and fine adjustment means, the latter being adjustable during reciprocation of said piston means to selectively determine the amount of food product drawn into said product cylinder from said feed hopper and dispensed from said product cylinder through said discharge port.

6. The invention defined in claim 5, wherein said dispensing means further includes control means actuating said first and second drive means to synchronize said charge and discharge strokes of said piston with said first and second positions of said valve member.

7. The invention defined in claim 5, wherein said dispensing means further includes:

sensing means sensing the presence and absence of a container at said filling position and disabling said second drive means in response to the absence of a said container to maintain said valve member in said first position during both said charge and discharge strokes of said piston.

8. The invention defined in claim 5, wherein said dispensing means further includes:

control means actuating said first and second drive means to synchronize said charge and discharge strokes of said piston with said first and second positions of said valve member; and sensing means sensing the presence and absence of a container at said filling position and disabling said second drive means in response to the absence of a said container to maintain said valve member in said first position during both said charge and discharge strokes of said piston.

9. The invention defined in claim 1, wherein said valve element comprises a cylindrical valve spool rotatably mounted in said valve means and having a spool cavity formed therein to selectively interconnect said product cylinder with said feed hopper and said discharge port in said first and second positions thereof, respectively; and wherein said second drive means comprises a pneumatic drive cylinder mounted on said valve means and having an extendable piston rod in driving connection with said valve spool, the extended and retracted positions of said extendable piston rod constraining said valve spool to said first and second positions, respectively, of said valve spool.

10. The invention defined in claim 9, wherein said dispensing means further includes control means actuating said first and second drive means to synchronize said charge and discharge strokes of said piston with said first and second positions of said valve member.

11. The invention defined in claim 9, wherein said dispensing means further includes:

sensing means sensing the presence and absence of a container at said filling position and disabling said second drive means in response to the absence of a said container to maintain said valve member in said first position during both said charge and discharge strokes of said piston.

12. The invention defined in claim 9, wherein said dispensing means further includes:

control means actuating said first and second drive means to synchronize said charge and discharge strokes of said piston with said first and second positions of said valve member; and sensing means sensing the presence and absence of a container at said filling position and disabling said second drive means in response to the absence of a said container to maintain said valve member in said first position during both said charge and discharge strokes of said piston.

13. The invention defined in claim 9, wherein said valve spool cavity is defined with arcuate edge portions cooperating with said discharge port to provide a scissors action on said food product when said valve spool is returned from said second to said first position by said second drive means.

14. The invention defined in claim 1, wherein said first and second drive means comprise first and second pneumatic drive cylinders having first and second extendable piston rods, respectively extended and retracted to drive, respectively, said piston through said discharge and charge strokes and said valve element to said first and second positions;

wherein said dispensing means further includes first and second pneumatic control means actuating said first and second drive means, respectively;

said first control means comprising first and second pneumatic pilot means continuously cylcled to provide charge and discharge stroke signals and a first control valve responsive to said signals to drive said first drive means and said piston in the provision of said charge and discharge stroke of the latter in said product cylinder;

said second control means comprising third and fourth pilot means to provide first and second valve element position signals, respectively and a second control valve responsive to said position signals to drive said second drive means and said valve element to said first and second positions; and wherein said timing means comprises cam means on said first extendable piston rod engageable with said fourth pilot means to actuate the latter and thereby constrain said second control valve and said second drive piston to constrain said valve element to return from said first position to said second position prior to the end of said charge stroke of said piston.

15. The invention defined in claim 14, wherein said fourth pilot means further includes container sensing pilot means precluding actuation of said fourth pilot means and precluding the provision of said second valve element position signal in the absence of a container at said filling position.

16. In a food product dispensing machine for filling each of a plurality of containers with a measured charge of food product from a feed hopper as said containers are sequentially presented at a filling station in said machine, the improvement comprising:

a dispensing valve having first and second operative positions;

a product cylinder having a reciprocating piston therein for charging said cylinder with food product and discharging food product from said cylinder in continuous alternating cycles;

said valve means interconnecting said product cylinder with said feed hopper in said first position and with a said container in said second position thereof in synchronism with said alternating charge and discharge cycles, respectively; and means driving said valve means to said positions and responsive to the position of said piston means during a discharge cycle to return said valve means from said second position to said first position after a predetermined portion of said discharge cycle to return food product to said feed hopper during the remainder of each said discharge cycle.

17. The invention defined in claim 16, wherein said means driving said valve means further includes container sensing means responsive to the absence of a said container at said filling station to maintain said valve means in said first position.

18. In a food product dispensing machine for filling each of a plurality of containers with a measured charge of food product from a feed hopper as said containers are sequentially presented at a filling station in said machine, the improvement comprising:

a dispensing valve having first and second operative positions;

product delivery means chargeable with said product in a first cycle of operation and discharging said product in a second cycle of operation, said cycles being continuous and alternating;

said valve means interconnecting said product delivery means with said feed hopper in said first position and with a said container in said second position thereof in synchronism with said alternating first and second cycles, respectively; and means driving said valve means and responsive to the completion of a predetermined portion of said second cycle of said product delivery means to return said valve means from said second position to said first position to return food product to said feed hopper during the remainder of each said second cycle of said product delivery means.

19. The invention defined in claim 18, wherein said means driving said valve means further includes container sensing means responsive to the absence of a said container at said filling station to maintain said valve means in said first position.

* * * * *